US006330805B1

(12) United States Patent
Galian

(10) Patent No.: US 6,330,805 B1
(45) Date of Patent: Dec. 18, 2001

(54) METHOD OF OPERATING A REFRIGERATING UNIT WITH A REFRIGERANT FLUID CIRCUIT

(76) Inventor: Francois Galian, 83 Avenue du Chateau, 77 340 Pontault Combault (FR)

( * ) Notice: Subject to any disclaimer, the term of this patent is extended or adjusted under 35 U.S.C. 154(b) by 0 days.

(21) Appl. No.: 09/154,078

(22) Filed: Sep. 16, 1998

(30) Foreign Application Priority Data

Sep. 16, 1997 (FR) ..... 97 11495

(51) Int. Cl.[7] ..... F25B 41/00; F25B 49/00

(52) U.S. Cl. ..... 62/196.1; 62/197; 62/198; 62/199; 62/117; 62/505

(58) Field of Search ..... 62/196.1, 197, 62/198, 199, 117, 505

(56) References Cited

U.S. PATENT DOCUMENTS

| | | | | |
|---|---|---|---|---|
| 2,958,209 | * | 11/1960 | Egon | 62/197 |
| 3,014,352 | * | 12/1961 | Leimbach | 62/197 |
| 3,243,970 | * | 4/1966 | Lippincott | 62/197 |
| 3,261,175 | * | 7/1966 | Fullerton | 62/197 |
| 3,369,374 | * | 2/1968 | Miller | 62/197 |
| 3,371,500 | * | 3/1968 | Marcus, Jr. | 62/117 |
| 3,396,550 | | 8/1968 | Cawley . | |
| 3,491,546 | | 1/1970 | Holzer . | |
| 3,498,074 | * | 3/1970 | Fineblum | 62/197 |
| 3,564,865 | * | 2/1971 | Spencer et al. | 62/197 |
| 3,631,684 | * | 1/1972 | Randall | 62/117 |
| 3,851,494 | | 12/1974 | Hess . | |
| 4,258,553 | * | 3/1981 | Kelly et al. | 62/117 |
| 4,550,574 | | 11/1985 | Hohman . | |
| 4,551,983 | | 11/1985 | Atsumi et al. . | |
| 4,633,674 | * | 1/1987 | Sato | 62/197 |
| 4,911,230 | | 3/1990 | Mayer et al. . | |
| 4,959,971 | * | 10/1990 | Minari | 62/197 |
| 4,986,084 | * | 1/1991 | Beckhusen | 62/197 |
| 5,243,827 | * | 9/1993 | Hagita et al. | 62/113 |
| 5,367,883 | | 11/1994 | Sakakibara et al. . | |
| 5,640,854 | * | 6/1997 | Fogt et al. | 62/197 |

FOREIGN PATENT DOCUMENTS

| | | |
|---|---|---|
| 0344397 | 12/1989 | (EP) . |
| 0348333 | 12/1989 | (EP) . |
| 1543666 | 10/1967 | (FR) . |
| 2195779 | 8/1974 | (FR) . |
| 2448115 A | 1/1980 | (FR) . |
| 999651 | 7/1965 | (GB) . |
| 1194006 | 6/1970 | (GB) . |
| 2042150A | 9/1980 | (GB) . |
| 1595616 | 8/1981 | (GB) . |
| 2114724A | 8/1983 | (GB) . |
| 2212942A | 1/1984 | (GB) . |
| 2130747A | 6/1984 | (GB) . |
| 2133521A | 7/1984 | (GB) . |
| 2254135A | 9/1992 | (GB) . |

* cited by examiner

*Primary Examiner*—Corrine McDermott
*Assistant Examiner*—Mark Norman
(74) *Attorney, Agent, or Firm*—Lowe Hauptman Gilman & Berner, LLP

(57) ABSTRACT

An air conditioning unit comprises a conventional refrigeration circuit including a conventional primary capillary for reducing the pressure of refrigerant flowing from a condenser outlet to an evaporator inlet. During abnormal operating conditions, i.e., when outside temperature is above a predetermined value, a secondary pressure reducing capillary bypasses the evaporator to supply refrigerant flowing out of the condenser to an inlet of a compressor, also responsive to refrigerant flowing out of the evaporator. Refrigerant flowing from the compressor flows into the condenser.

6 Claims, 1 Drawing Sheet

METHOD OF OPERATING A REFRIGERATING UNIT WITH A REFRIGERANT FLUID CIRCUIT

FIELD OF INVENTION

The present invention relates to a refrigeration unit for variable operating conditions, more particularly an air conditioning unit or refrigeration assembly operating under highly variable outside temperatures and highly variable refrigerating powers.

BACKGROUND ART

Air conditioning and refrigeration assemblies generally include a compressor having alternating ON/OF sequences for regulating the required refrigerating power. The pressure of liquid refrigerant circulating through the unit or assembly is reduced either by (1) a capillary means in the most conventional type of equipment, or (2) thermostatic pressure reducers in more advanced equipment being presently used.

Both solutions entail regulating the condensation temperature and keeping a supply of liquid in a tank upstream of the pressure reducer.

Moreover, the pressure reducers are either:

(1) fragile mechanical devices; for example, a thermostatic pressure reducing valve, frequently referred to as an expansion valve, or (2) costly electronic pressure reducers.

SUMMARY OF THE INVENTION

One feature of the unit of the invention is to increase the reliability of an air conditioning unit or refrigeration assembly pressure reducer by employing two pressure reducers, such as capillaries, instead of only one capillary as is conventional. Adding a second pressure reducer eliminates the need for having a liquid tank for storing a volume of refrigerant upstream of the pressure reducer. The second capillary enables matching of outside temperatures and variable refrigeration loads.

The invention decreases the need for refrigerant-fluid charging and almost entirely eliminates the danger of liquid impacts on the service life of the equipment.

Another advantage of the invention is that the added part is wholly static to provide a substantial increase in the refrigeration assembly reliability.

The refrigeration unit of the present invention, which can operate under various conditions, comprises at least one evaporator, a compressor, a primary pressure reducer and a condenser, in one main refrigerant-fluid circuit, in combination with a secondary pressure reducer. The primary pressure reducer feeds an evaporator under normal operating conditions while the secondary pressure reducer shunts some saturated high pressure gases flowing from the condenser to the compressor and around the evaporator when the actual operating conditions are abnormal, such that the refrigerant flowing from the evaporator has a higher pressure than normal.

The above and still further objects, features and advantages of the present invention will become apparent upon consideration of the following detailed description of one specific embodiment thereof, especially when taken in conjunction with the accompanying drawings.

BRIEF DESCRIPTION OF DRAWING

The sole FIGURE is a functional block diagram of a preferred embodiment of the invention.

DESCRIPTION OF THE PREFERRED EMBODIMENT

Figure 1:
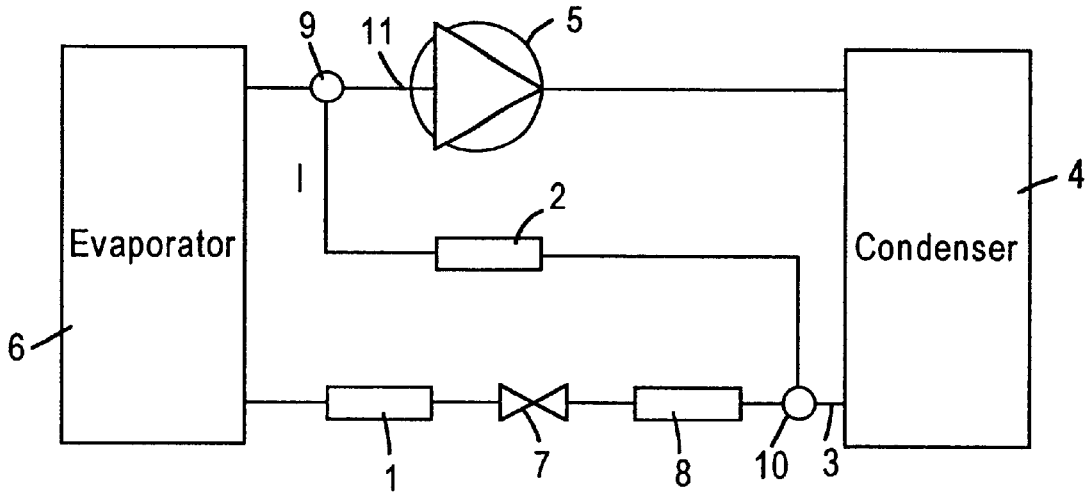

The embodiment of the invention illustrated in the FIGURE includes a pressure reducing capillary 1, having a size selected for standard operation of a refrigeration assembly, particularly a domestic air conditioner. The refrigerant charge volume is selected to be just enough for desired standard operation. The defined charge causes the refrigerant to be fed as a gas to secondary capillary 2 when outside temperature is higher than a predetermined, i.e., standard, value, e.g., 20° C. The higher outside temperature causes the pressure of the refrigerant gas supplied to secondary capillary 2 to be saturated and abnormally high. When the outdoor temperature is less than the predetermined value, the refrigerant is fed as a liquid to capillary 2.

Secondary capillary 2 reduces the refrigerant output of compressor 5, as coupled through condenser 4, when the condensation pressure of the refrigerant rises to facilitate starting the refrigeration assembly when the temperature of refrigerant flowing from condenser 4 is abnormally high. When the refrigeration requirements and condensation temperatures decrease due to a decrease in outdoor temperature, the volume of superheated gas at suction side 11 of compressor 5 increases and in general causes the compressor to stop by triggering a safety device of the compressor. When secondary capillary 2 is supplied with liquid and injects liquid into suction side 11 of compressor 5, a safety device of compressor 5 responds to the liquid at suction side 11 to commensurately move back the triggering point of the safety device.

As typical, compressor 5 is equipped with the safety device for sensing the thermal equilibrium of the circulating fluid. Compressor 5 is loaded on its inlet 11 by a liquid vapor refrigerant mixture to provide its outlet with a more gaseous mixture. To reduce risks from excessively high pressures, the safety device is mounted in the inlet pipe of compressor 5. The safety device controls an electric driver of the motor of compressor 5. As the fluid at inlet 11 becomes more liquid and less gaseous due to the secondary capillary element 2 bypassing refrigerant from condenser 4 around evaporator 6, the triggering point of the safety device in compressor 5 is moved to become more distant from its initial normal value.

Possible alternate embodiments of the invention are discussed below.

The embodiment of the invention is not restricted to the one shown in the attached FIGURE. The invention can include a number of variations, in particular regarding the number of its main components. For example, each of pressure reducers 1 and 2 can include more than one capillary.

In one embodiment, secondary pressure reducer 2 is preferably a capillary for injecting liquid into an input port of the T-branch 9 when superheating is increased by secondary pressure reducer 2 being operational, whereby the secondary pressure reducer cools the gases at suction side 11 of compressor 5.

In a preferred embodiment, the refrigeration assembly need not include a tank for storing liquid refrigerant. Consequently, the refrigeration assembly can operate in a lack-of-liquid state when the outside temperature exceeds the predetermined value.

In another embodiment of the invention, T-branch 10 having an outlet port leading to secondary pressure reducer 2 is connected to high-pressure conduit 3 filled with liquid at the outlet of condenser 4 of the refrigeration circuit.

In another embodiment, an outlet of T-branch 10 is connected to secondary pressure reducer 2, in turn connected to pipe 3, at the outlet of condenser 4. Pipe 3 is not filled with refrigerant liquid, but can include some refrigerant gas during standard operation when the outside temperature is less than the predetermined temperature.

In another embodiment of the invention, the refrigeration assembly of the invention comprises moisture detector 8 on the high-pressure, inlet side of primary pressure reducer 1. Moisture detector 8, a hybrid mechanical and chemical moisture detector including a window for enabling a viewer to visually detect abnormally high moisture (as indicated by the color of the fluid) in the fluid flowing to pressure reducer 1, is in series in the flow circuit of the refrigerant fluid. In the illustrated embodiment moisture detector 8 is connected to the low-pressure outlet port of T-branch 10 feeding the primary pressure reducer 1. A moisture detector can also be connected in the conduit between T-branch 10 and secondary capillary 2.

In an alternative embodiment, the refrigeration unit of the invention also includes a power regulator for compressor 5. The unit can also include a controller programmed to control start-up, for instance, in the following manner:

1. start the compressor while the supply of refrigerant fluid for evaporator 6 is shut off and electrically close valve 7, connected in series with the inlet of primary capillary 1;
2. evaporate residual refrigerant liquid in evaporator 6 by heating the evaporator;
3. feed a standard supply of refrigerant to evaporator 6 via primary capillary 1 by opening valve 7.

The controller can also be programmed for OFF operation of the unit by executing the following sequence:

1. shutoff flow of refrigerant fluid to evaporator 6 via primary capillary 1 by closing valve 7;
2. evaporate residual refrigerant fluid in evaporator 6 by heating the refrigerant fluid in the evaporator;
3. shutoff refrigeration compressor 4.

The regulator and/or controller provides programmed start-up and programmed shutoff control by closing and opening electric valve 7 with appropriate electric signals.

The disclosure of the present invention includes an ambient-air air conditioner comprising at least one and possibly several refrigeration units disclosed above.

Pressure reducers 1 and 2, such as a capillary or a diaphragm, used in the main refrigeration circuit and in the line shunting the main circuit are preferably static devices. Accordingly, the refrigeration unit of the invention is self-adapting and its operating point depends on the dimensions of the refrigeration unit components and any electric valve as discussed above. In particular, the refrigeration unit of the invention can operate in the absence of any pickup or any thermostat or external control device.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A method of operating a refrigerating unit with a refrigerant fluid circuit including a compressor, condenser, primary pressure reducer and evaporator connected in a fluid circuit so during normal operation of the refrigeration unit refrigerant: (1) at an outlet of the evaporator flows to an inlet of the compressor, (2) at an outlet of the compressor flows to an inlet of the condenser, (3) at an outlet of the condenser flows to an inlet of the primary pressure reducer and (4) at an outlet of the primary pressure reducer flows to an inlet of the evaporator, the method comprising shunting saturated high pressure refrigerant gas flowing out of the condenser when ambient temperature where the unit is located exceeds a predetermined value around the evaporator, and combining the reduced pressure shunted refrigerant with refrigerant flowing out of the evaporator before the reduced pressure shunted refrigerant flows into the compressor, and supplying the combined refrigerant to the compressor.

2. The method of claim 1 wherein the refrigerant is Supplied to the secondary pressure reducer as a gas when the predetermined value is exceeded and the refrigerant is supplied to the secondary pressure reducer as a liquid when the predetermined value is not exceeded, at least some of the shunted refrigerant flowing as a liquid to form the combined refrigerant during both normal and abnormal operation.

3. The method of claim 2 wherein the predetermined value is approximately 20° C.

4. A method of operating a refrigerating unit with a refrigerant fluid circuit including a compressor, condenser, primary pressure reducer and evaporator connected in a fluid circuit so during normal operation of the refrigeration unit refrigerant: (1) at an outlet of the evaporator flows to an inlet of the compressor, (2) at an outlet of the compressor flows to an inlet of the condenser, (3) at an outlet of the condenser flows to an inlet of the primary pressure reducer and (4) at an outlet of the primary pressure reducer flows to an inlet of the evaporator, the method comprising, during abnormal operation of the unit: (1) causing the refrigerant to flow (a) via the same path as during normal operation and (b) as a saturated, high pressure gas into a shunt path that by-passes the evaporator, (2) reducing the pressure of the saturated, high pressure refrigerant in the shunt path, and (3) supplying the reduced pressure refrigerant in the shunt path to the compressor.

5. The method of claim 4 wherein (1) the refrigerant flows into and out of the shunt path as a liquid during normal operation, and (2) at least some of the refrigerant flowing out of the shunt path during abnormal operation is a liquid.

6. The method of claim 5, further comprising sensing the thermal equilibrium of refrigerant flowing into the compressor, controlling on and off operation of the compressor in response to the sensed thermal equilibrium being greater and less than a trigger point, and changing the trigger point as the refrigerant flowing into the compressor from the shunt path and the evaporator becomes more liquid and less gaseous.

* * * * *